US011441203B2

(12) United States Patent
Fukuda et al.

(10) Patent No.: US 11,441,203 B2
(45) Date of Patent: Sep. 13, 2022

(54) METHOD FOR QUENCHING STEEL PIPE, EQUIPMENT FOR QUENCHING STEEL PIPE, AND METHOD FOR MANUFACTURING STEEL PIPE

(71) Applicant: JFE Steel Corporation, Tokyo (JP)

(72) Inventors: Hiroyuki Fukuda, Tokyo (JP); Hiroyuki Yamasaki, Tokyo (JP); Yasuhiro Nagayama, Tokyo (JP); Ryosuke Tachi, Tokyo (JP); Shunsuke Sasaki, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 96 days.

(21) Appl. No.: 16/954,273

(22) PCT Filed: Nov. 20, 2018

(86) PCT No.: PCT/JP2018/042808
§ 371 (c)(1),
(2) Date: Jun. 16, 2020

(87) PCT Pub. No.: WO2019/123945
PCT Pub. Date: Jun. 27, 2019

(65) Prior Publication Data

US 2021/0087643 A1 Mar. 25, 2021

(30) Foreign Application Priority Data

Dec. 19, 2017 (JP) ..... JP2017-242348

(51) Int. Cl.
*C21D 9/08* (2006.01)
*C21D 1/667* (2006.01)

(52) U.S. Cl.
CPC ..... *C21D 9/085* (2013.01); *C21D 1/667* (2013.01)

(58) Field of Classification Search
CPC ..... C21D 9/085; C21D 1/667
See application file for complete search history.

(56) References Cited

U.S. PATENT DOCUMENTS 4,461,462 A * 7/1984 Mizushima ..... C21D 9/085 266/134
4,575,052 A * 3/1986 Ebata ..... C21D 1/62 266/88

(Continued)

FOREIGN PATENT DOCUMENTS

JP 56166325 A 12/1981
JP 5923819 A 2/1984

(Continued)

OTHER PUBLICATIONS

David D. Hall and Issam Mudawar, "Experimental and numerical study of quenching complex-shaped metallic alloys with multiple, overlapping sprays", May 1995, International Journal of Heat and Mass Transfer, vol. 38 Issue 7, pp. 1201-1216 (Year: 1995).*

(Continued)

*Primary Examiner* — Nicholas A Wang
*Assistant Examiner* — Maxwell Xavier Duffy
(74) *Attorney, Agent, or Firm* — RatnerPrestia

(57) ABSTRACT

The invention is intended to provide a method for quenching a steel pipe, equipment for quenching a steel pipe, and a method of manufacturing a steel pipe that enable a steel pipe to be conveyed at high speed. The method for quenching a steel pipe includes the steps of: conveying a steel pipe onto a rotatable supporting member using a walking-arm type revolving conveyance apparatus; and rapidly cooling the steel pipe with first spray nozzles disposed above the pipe while the steel pipe is being rotated about a pipe axis of the steel pipe on the rotatable supporting member in a state (Continued)

$$\theta_1 = \arctan(S_1/H_1)$$
$$\theta_2 = \arctan(S_2/H_2)$$

where movements of the steel pipe in a direction parallel to and in a direction perpendicular to the pipe axis are stopped.

18 Claims, 11 Drawing Sheets

(56) References Cited

U.S. PATENT DOCUMENTS

| | | | | |
|---|---|---|---|---|
| 4,834,344 | A * | 5/1989 | Hoetzl | C21D 1/667 266/259 |
| 2017/0159142 | A1 | 6/2017 | Wang et al. | |
| 2017/0349965 | A1* | 12/2017 | Fukuda | C21D 1/667 |

FOREIGN PATENT DOCUMENTS

| | | | | |
|---|---|---|---|---|
| JP | 60245719 | A | 12/1985 | |
| JP | 3207817 | A | 9/1991 | |
| JP | 7288479 | A | 10/1995 | |
| JP | 8333636 | A | 12/1996 | |
| JP | 9225520 | A | 9/1997 | |
| JP | 2009243579 | A | 10/2009 | |
| WO | 2016125425 | A1 | 8/2016 | |
| WO | WO-2016125425 | A1 * | 8/2016 | B21B 23/00 |

OTHER PUBLICATIONS

International Search Report and Written Opinion for International Application No. PCT/JP2018/042808, dated Feb. 19, 2019, 5 pages.

Extended European Search Report for European Application No. 18 891 270.3, dated Jul. 2, 2020, 10 pages.

Sakamoto, A., et al., "Water Cooling Technologies for Steel Pipe Production Processes," Mar. 31, 2016, Nippon Steel & Sumitomo Metal Technical Report No. 111, pp. 107-112, XP055707464, Retrieved from the Internet: https://www.nipponsteel.com/en/tech/report/nssmc/pdf/111-16.pdf [retrieved on Jun. 22, 2020].

* cited by examiner

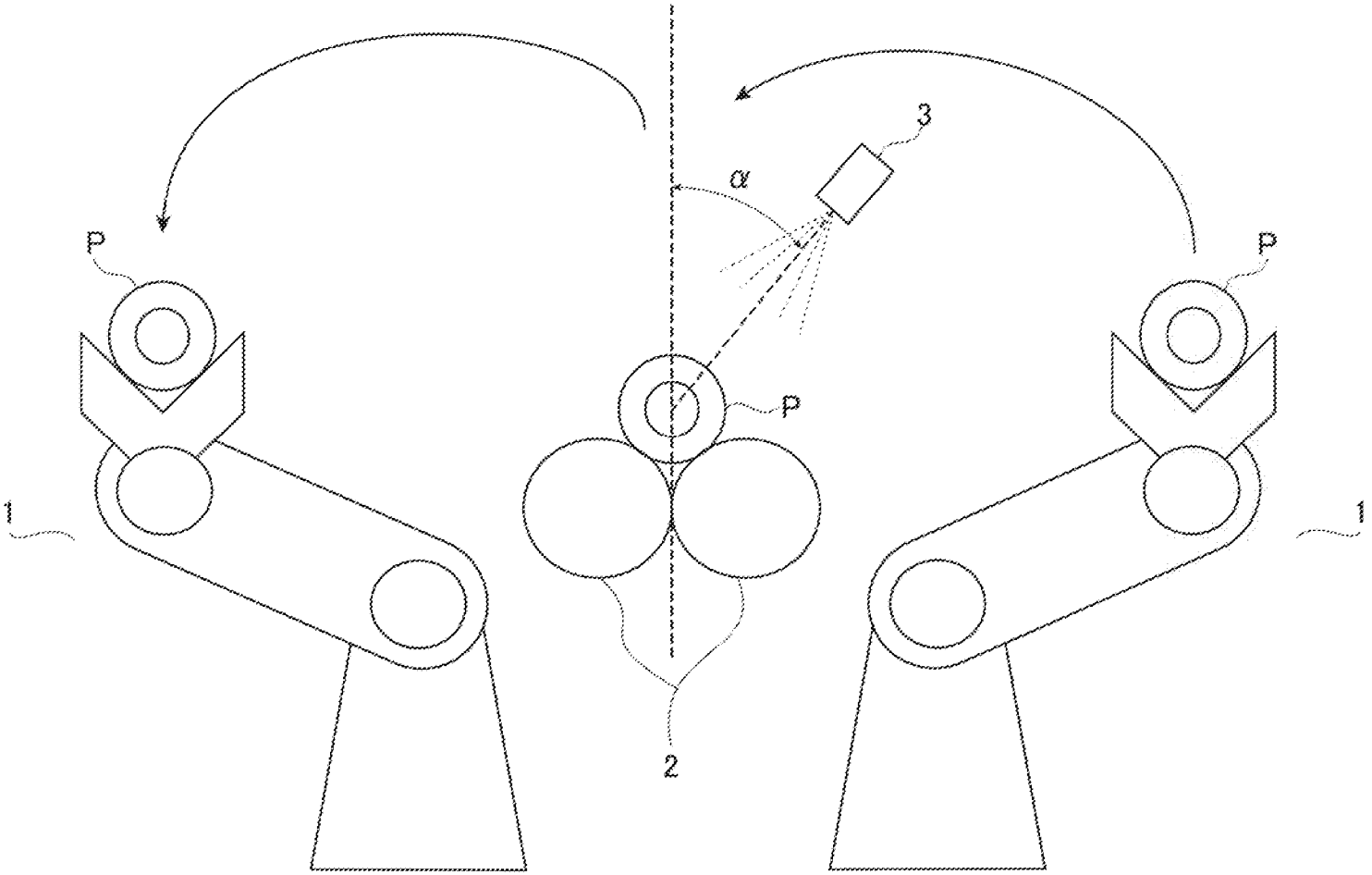
[ FIG. 1 ]

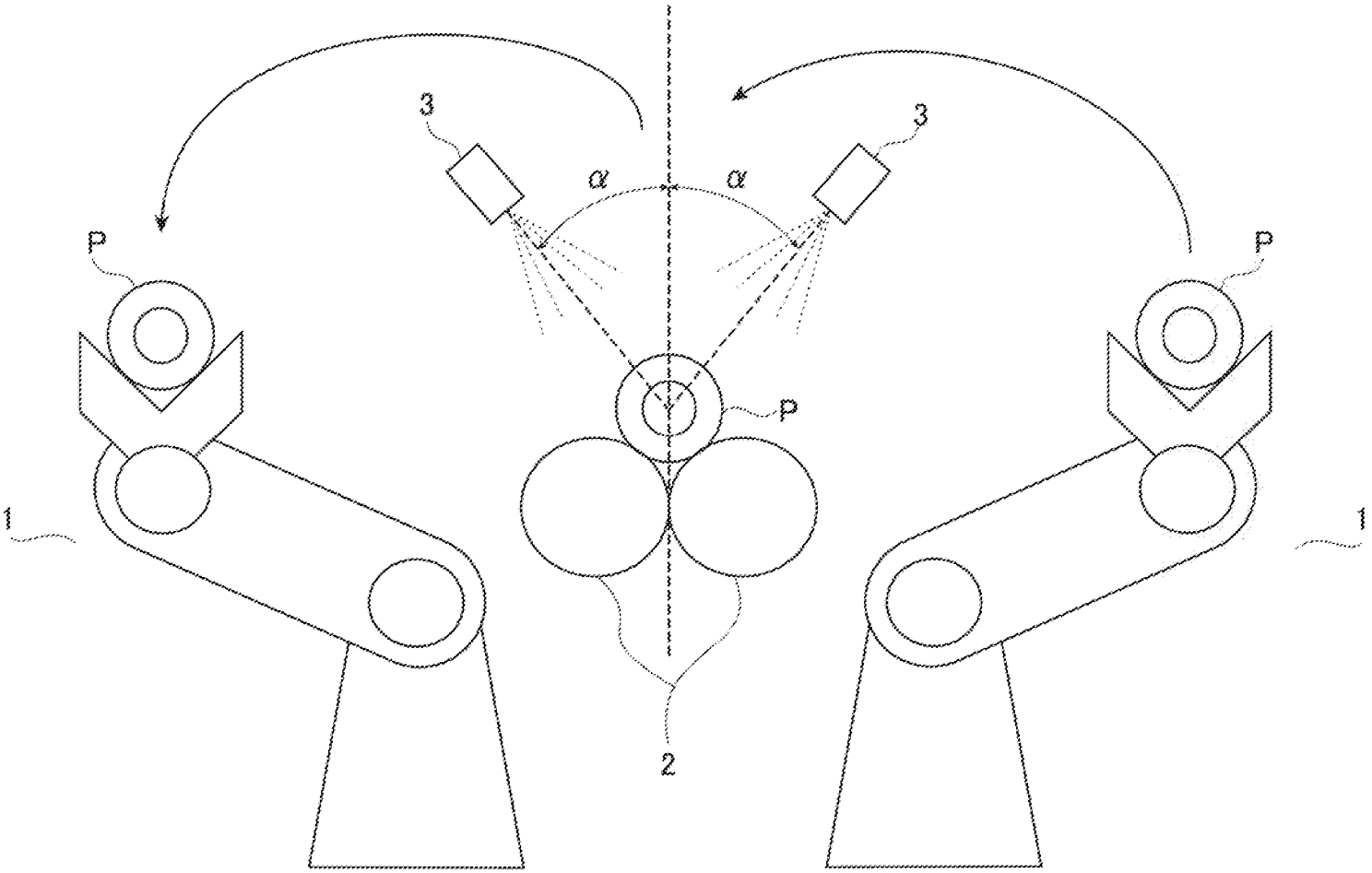
[ FIG. 2 ]

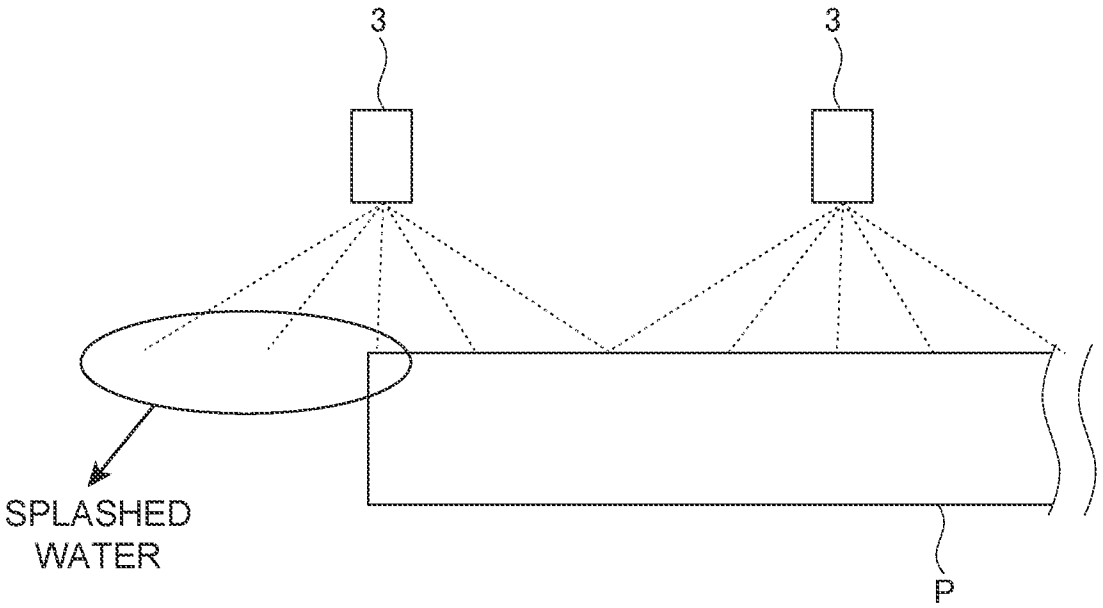
[ FIG. 3 ]

$\theta_1 = \arctan(S_1/H_1)$
$\theta_2 = \arctan(S_2/H_2)$
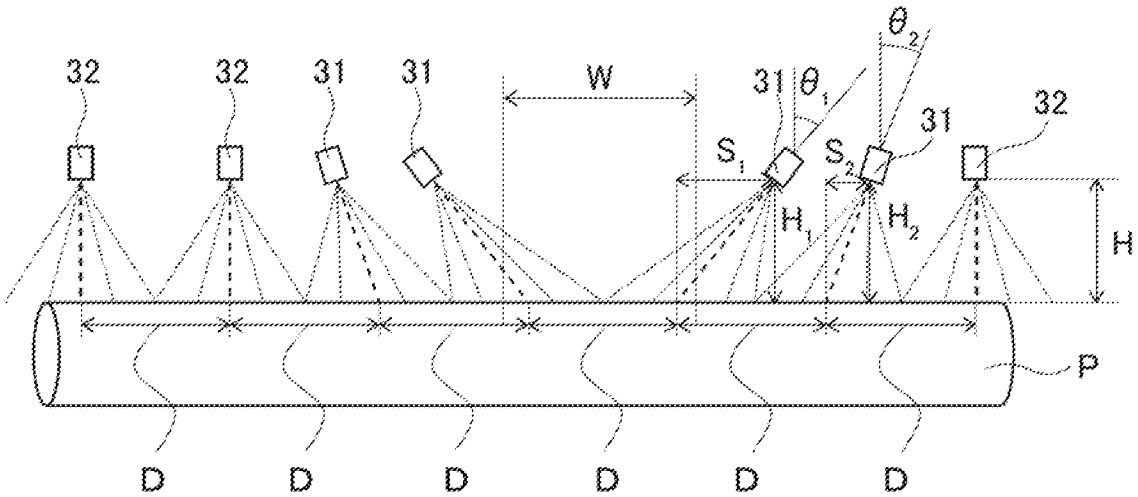
[FIG. 4]

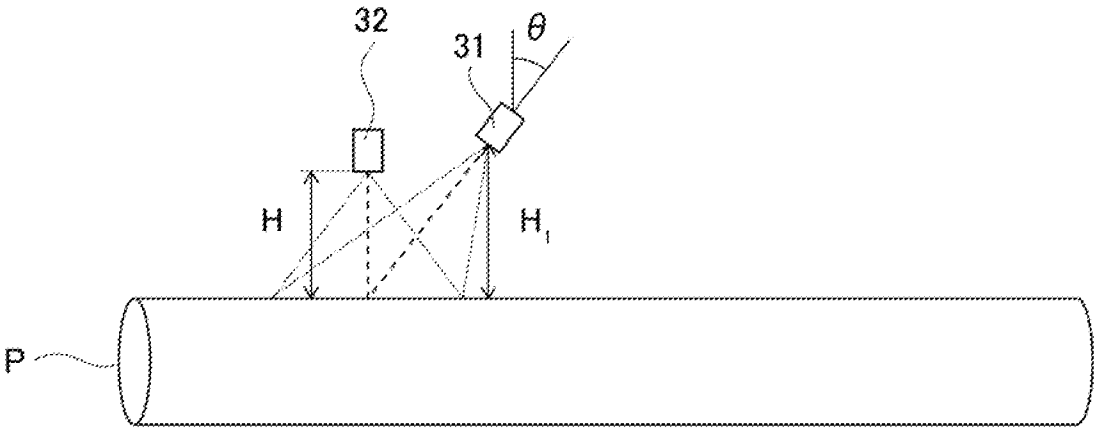
[FIG. 5]

[ FIG. 6 ]
(a)
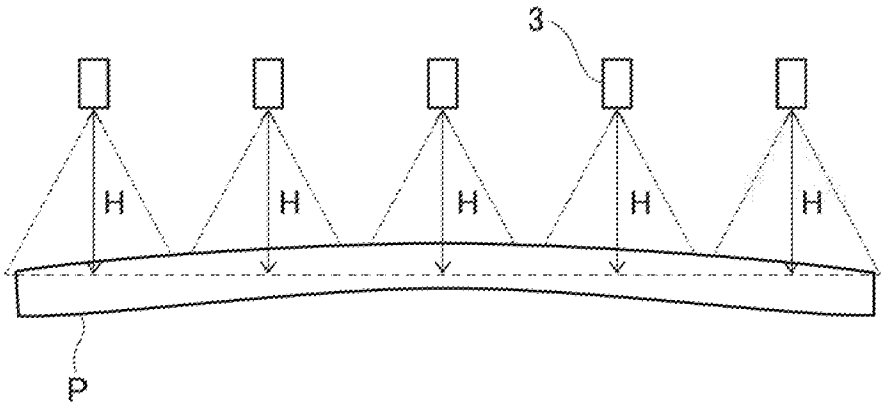
(b)
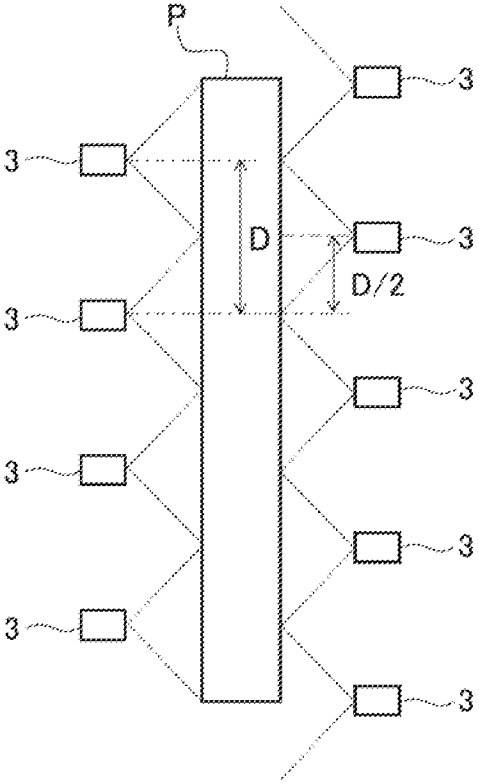

[ FIG. 7 ]
(a)
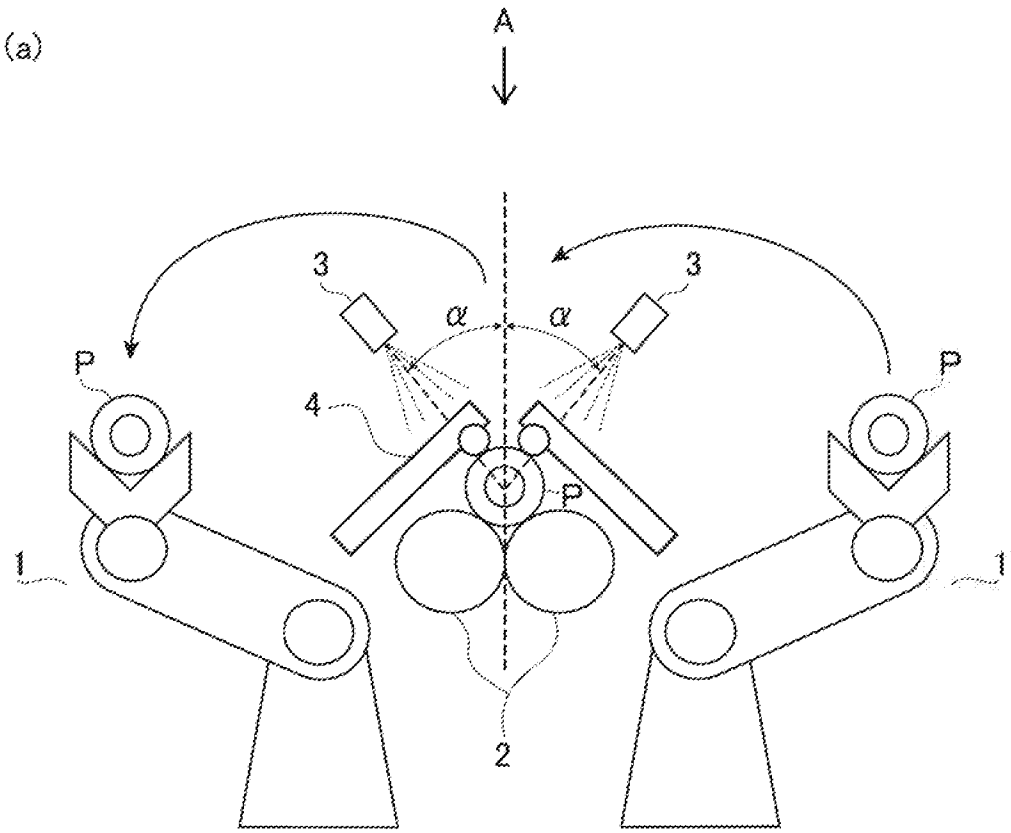
(b)
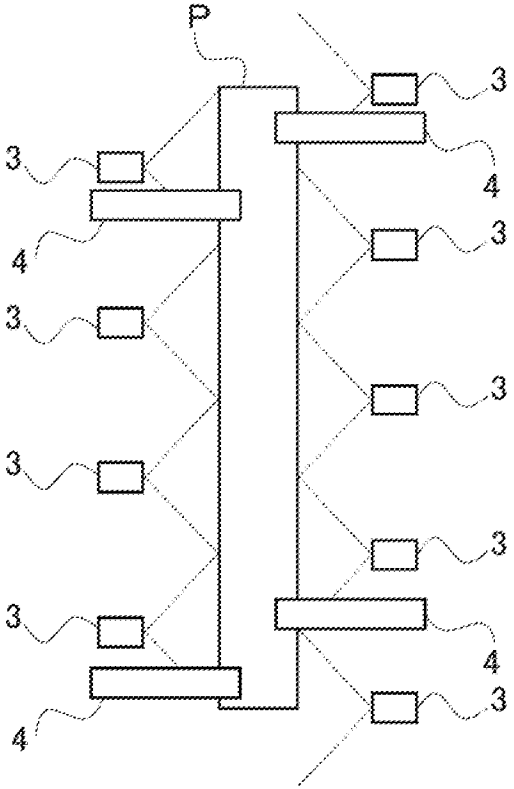

[ FIG. 8 ]
(a)
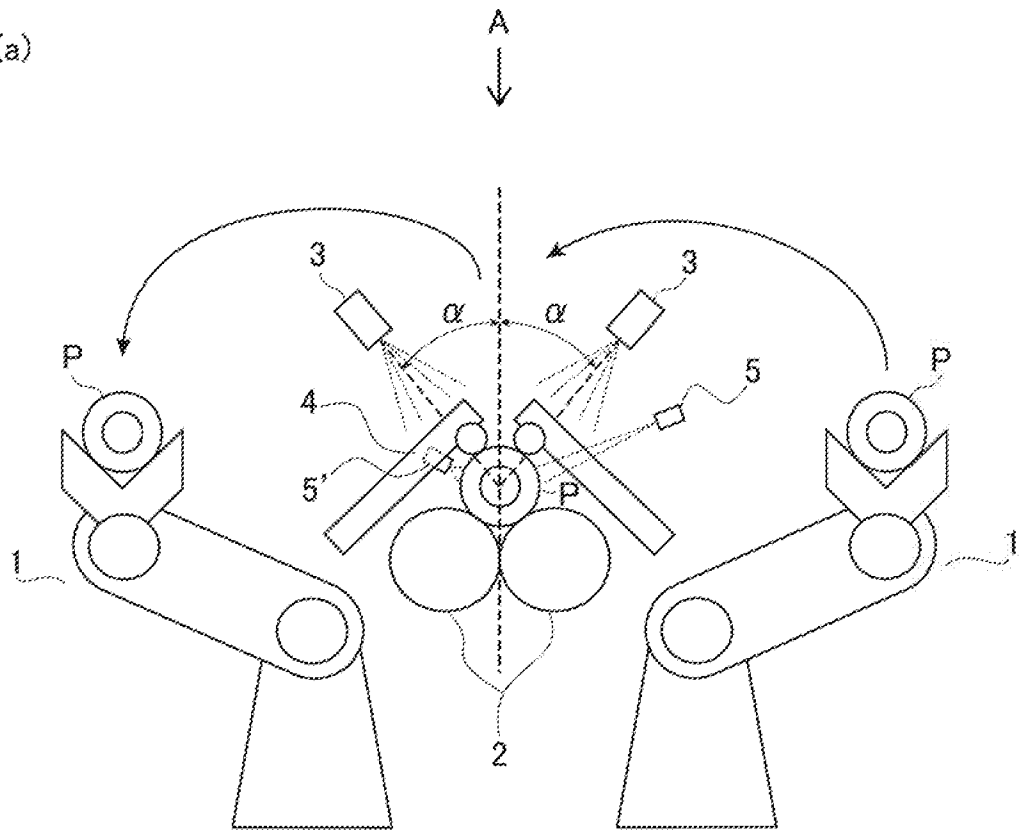
(b)
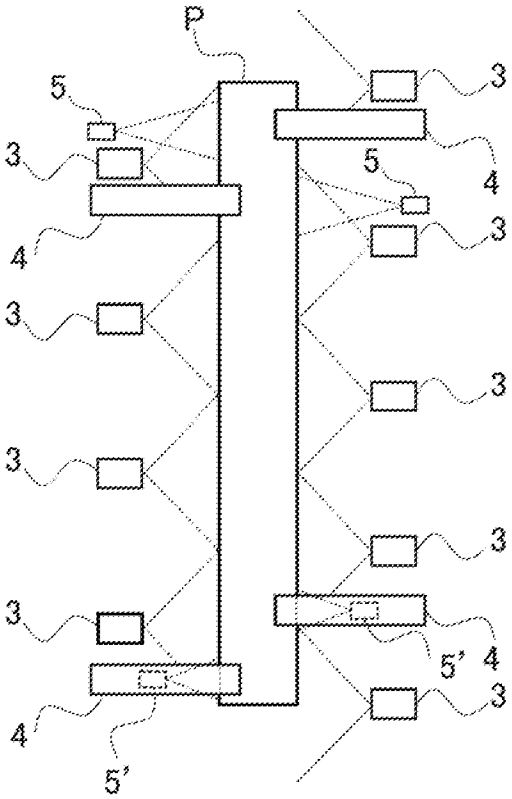

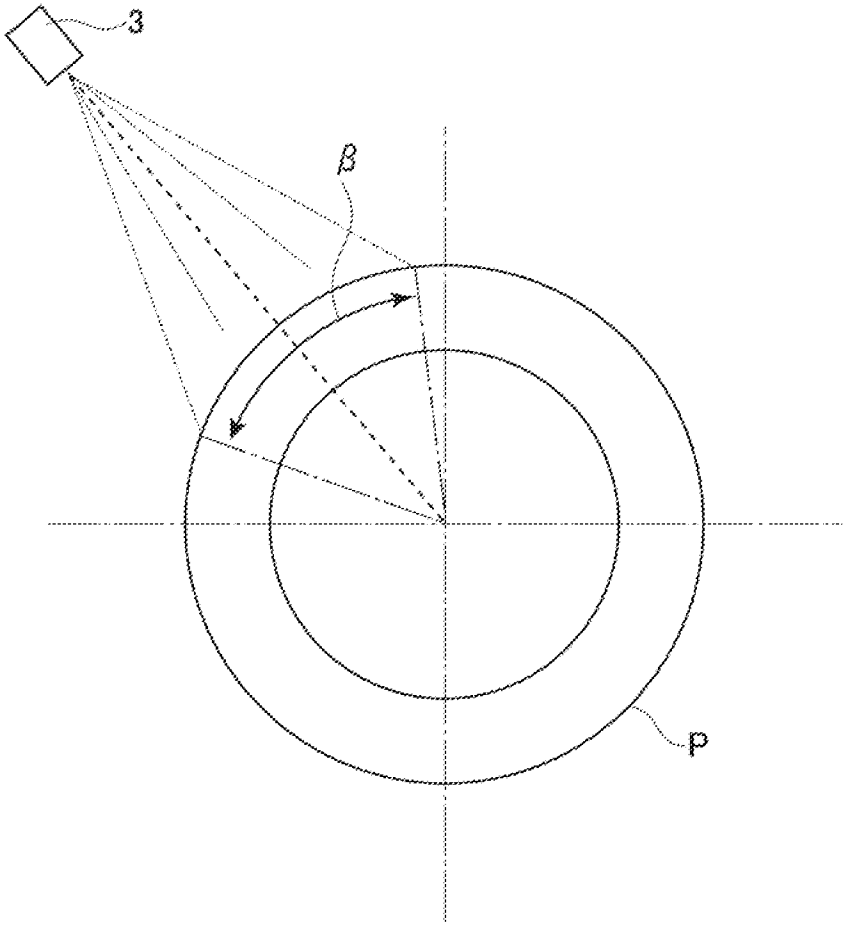
[ FIG. 9 ]

[ FIG. 10 ]
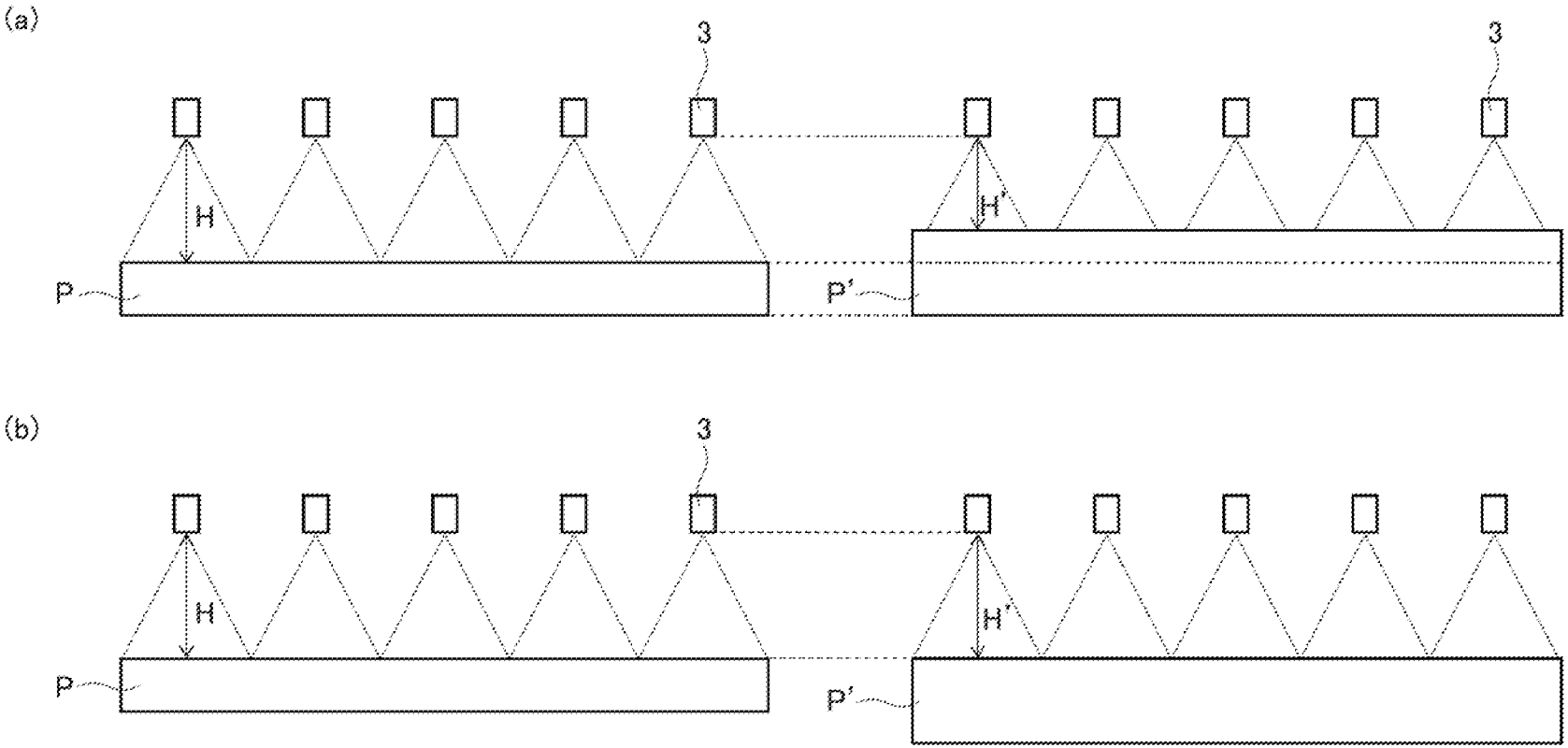

[ FIG. 11 ]
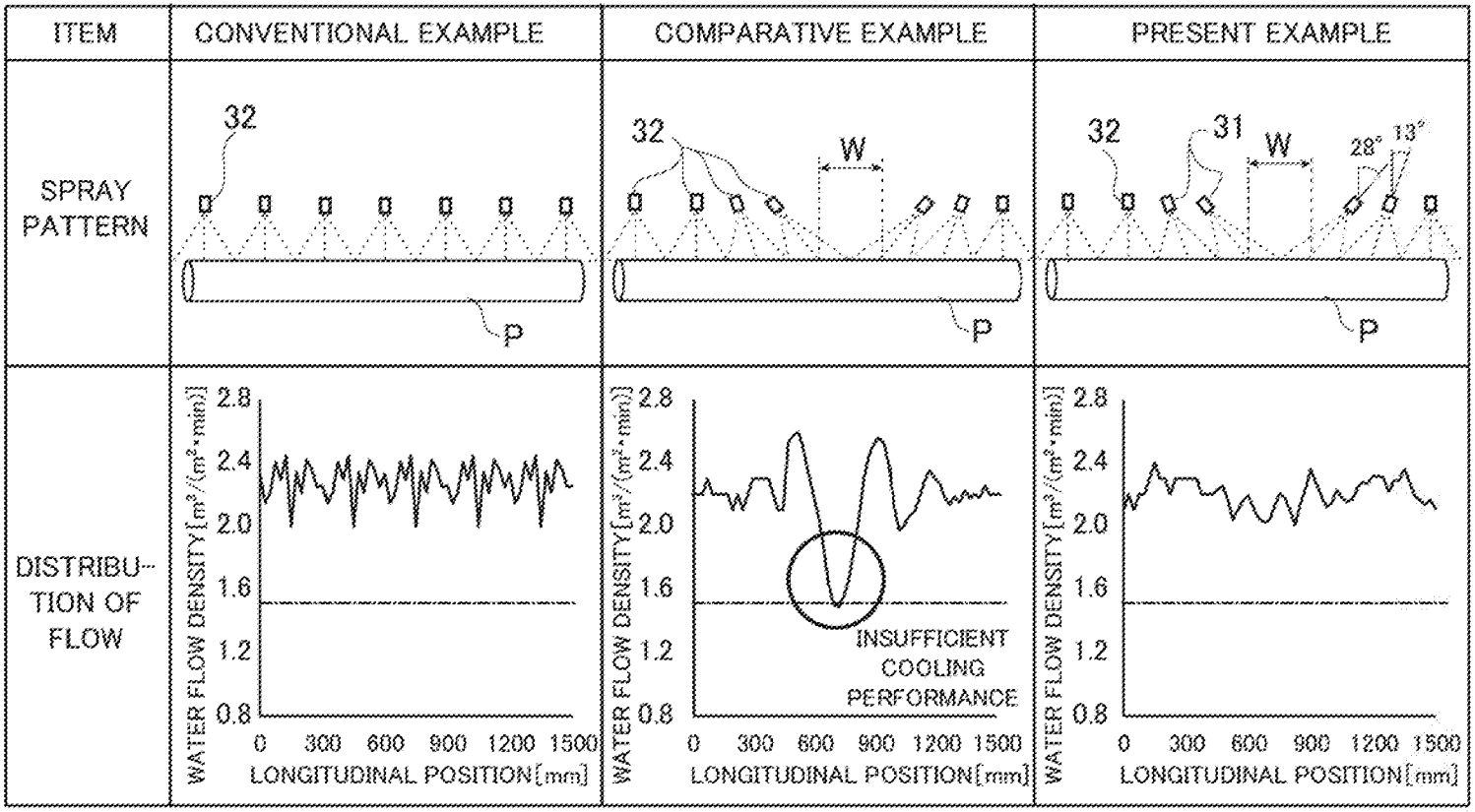

METHOD FOR QUENCHING STEEL PIPE, EQUIPMENT FOR QUENCHING STEEL PIPE, AND METHOD FOR MANUFACTURING STEEL PIPE

CROSS REFERENCE TO RELATED APPLICATIONS

This is the U.S. National Phase application of PCT/JP2018/042808, filed Nov. 20, 2018, which claims priority to Japanese Patent Application No. 2017-242348, filed Dec. 19, 2017, the disclosures of these applications being incorporated herein by reference in their entireties for all purposes.

FIELD OF THE INVENTION

The present invention relates to a method for quenching a steel pipe, equipment for quenching a steel pipe, and a method of manufacturing a steel pipe.

BACKGROUND OF THE INVENTION

A steel pipe such as a seamless pipe is quenched to increase strength and toughness. This is achieved either by rapidly cooling a steel pipe after heating it to a predetermined heat treatment temperature, or by directly subjecting a hot-rolled high-temperature steel pipe to rapid cooling.

For example, PTL 1 discloses a method of rapid cooling in which an oscillating means is used to oscillate rows of spray nozzles in a longitudinal direction of a steel pipe as a rotating means rotates the steel pipe, allowing cooling water to cover the whole steel pipe, and rapidly cool the steel pipe in a uniform fashion.

PATENT LITERATURE

PTL 1: JP-A-H03-207817

SUMMARY OF THE INVENTION

However, the quenching equipment of PTL 1 requires large intervals for steel pipes in order to prevent splashed water from making contact with a succeeding pipe and a preceding pipe during quenching. Accordingly, it takes a long time to convey steel pipes, and the productivity is poor. The technique also requires a mechanism for oscillating rows of spray nozzles in longitudinal direction, and the initial cost is high.

One way of conveying a steel pipe in quenching equipment is a method using a kicker. However, this method takes a long time for conveyance of a steel pipe, and involves hitting damage and other troubles due to bending of a steel pipe during conveyance.

Aspects of the present invention are intended to provide a solution to the foregoing problems, and it is an object according to aspects of the invention to provide a method for quenching a steel pipe, equipment for quenching a steel pipe, and a method of manufacturing a steel pipe that enable a steel pipe to be conveyed at high speed.

The present inventors conducted intensive studies, and found that rapid conveyance of a steel pipe is possible when a walking-arm type revolving conveyance apparatus (also referred to as "swing-arm type conveyance apparatus" in this specification) is used for conveyance of a steel pipe. It was also found that a uniform distribution of flow of cooling medium can be achieved with a spray pattern created with the use of inclined spray nozzles and flat spray nozzles, even in a swept range of the walking-arm type revolving conveyance apparatus where spray nozzles cannot be disposed, and that this enables uniform rapid cooling in a longitudinal direction of a steel pipe.

Aspects of the present invention have been completed on the basis of these findings, and are as follows.

[1] A method for quenching a steel pipe, the method comprising the steps of:

conveying a steel pipe onto a rotatable supporting member using a walking-arm type revolving conveyance apparatus; and rapidly cooling the steel pipe with first spray nozzles disposed above the pipe while the steel pipe is being rotated about a pipe axis of the steel pipe on the rotatable supporting member in a state where movements of the steel pipe in a direction parallel to and in a direction perpendicular to the pipe axis are stopped, the first spray nozzles being disposed along an axial direction of the steel pipe with an angle of 20 to 70° from the uppermost part of the pipe in a circumferential direction, the first spray nozzles being disposed except a swept range W of the walking-arm type revolving conveyance apparatus in a longitudinal direction of the steel pipe, the first spray nozzles including inclined spray nozzles that are disposed by being tilted toward the swept range W, and flat spray nozzles that are disposed adjacent to the inclined spray nozzles at equal intervals with a predetermined pitch D in the longitudinal direction of the steel pipe, the inclined spray nozzles being disposed by being offset by a distance S from the predetermined pitch D, and being tilted with an angle θ of 30° or less, where the angle θ is determined in terms of the relationship $\theta = \arctan(S/H)$, where S is the distance from the predetermined pitch D of the flat spray nozzles and H is an injection height of the first spray nozzles.

[2] The method for quenching a steel pipe according to item [1], wherein the first spray nozzles disposed above the pipe are disposed opposite to each other across the longitudinal direction of the steel pipe lying in the middle.

[3] The method for quenching a steel pipe according to item [2], wherein the first spray nozzles disposed above the pipe are disposed opposite to each other with offset of a pitch of D/4 to 3D/4 along the longitudinal direction of the steel pipe.

[4] The method for quenching a steel pipe according to item [2] or [3], wherein the walking-arm type revolving conveyance apparatus includes a pipe hold-down member that holds down the steel pipe rotating on the rotatable supporting member.

[5] The method for quenching a steel pipe according to item [4], wherein the walking-arm type revolving conveyance apparatus includes second spray nozzles that rapidly cool a region where the first spray nozzles disposed above the pipe interfere with the pipe hold-down member.

[6] The method for quenching a steel pipe according to any one of items [1] to [5], wherein the rotatable supporting member, and/or the first spray nozzles disposed above the pipe are movable in a vertical direction according to an outer diameter of the steel pipe.

[7] Equipment for quenching a steel pipe, the equipment comprising:

a walking-arm type revolving conveyance apparatus for conveying a steel pipe;

a rotatable supporting member that supports the steel pipe conveyed by the walking-arm type revolving conveyance apparatus, the rotatable supporting member supporting the steel pipe by rotating the steel pipe about a pipe axis of the steel pipe in a state where movements of the steel pipe in a direction parallel to and in a direction perpendicular to the pipe axis are stopped; and first spray nozzles that rapidly cool the steel pipe from above the steel pipe rotating on the rotatable supporting member, the first spray nozzles being disposed along an axial direction of the steel pipe with an angle of 20 to 70° from the uppermost part of the pipe in a circumferential direction, the first spray nozzles being disposed except a swept range W of the walking-arm type revolving conveyance apparatus in a longitudinal direction of the steel pipe, the first spray nozzles including inclined spray nozzles that are disposed by being tilted toward the swept range W, and flat spray nozzles that are disposed adjacent to the inclined spray nozzles at equal intervals with a predetermined pitch D in the longitudinal direction of the steel pipe, the inclined spray nozzles being disposed by being offset by a distance S from the predetermined pitch D, and being tilted with an angle θ of 30° or less, where the angle θ is determined in terms of the relationship θ=arctan(S/H), where S is the distance from the predetermined pitch D of the flat spray nozzles and H is an injection height of the first spray nozzles.

[8] The equipment for quenching a steel pipe according to item [7], wherein the first spray nozzles disposed above the pipe are disposed opposite to each other across the longitudinal direction of the steel pipe lying in the middle.

[9] The equipment for quenching a steel pipe according to item [8], wherein the first spray nozzles disposed above the pipe are disposed opposite to each other with offset of a pitch of D/4 to 3D/4 along the longitudinal direction of the steel pipe.

[10] The equipment for quenching a steel pipe according to item [8] or [9], further comprising a pipe hold-down member that holds down the steel pipe rotating on the rotatable supporting member.

[11] The equipment for quenching a steel pipe according to item [10], further comprising second spray nozzles that rapidly cool a region where the first spray nozzles disposed above the pipe interfere with the pipe hold-down member.

[12] The equipment for quenching a steel pipe according to anyone of items [7] to [11], wherein the rotatable supporting member, and/or the first spray nozzles disposed above the pipe are movable in a vertical direction according to an outer diameter of the steel pipe.

[13] A method of manufacturing a steel pipe by quenching whereby a steel pipe as raw material is rapidly cooled after heating, or a hot-rolled high-temperature steel pipe is directly subjected to rapid cooling, the rapid cooling in the quenching comprising the steps of:

conveying a steel pipe onto a rotatable supporting member using a walking-arm type revolving conveyance apparatus; and rapidly cooling the steel pipe with first spray nozzles disposed above the pipe while the steel pipe is being rotated about a pipe axis of the steel pipe on the rotatable supporting member in a state where movements of the steel pipe in a direction parallel to and in a direction perpendicular to the pipe axis are stopped, the first spray nozzles being disposed along an axial direction of the steel pipe with an angle of 20 to 70° from the uppermost part of the pipe in a circumferential direction, the first spray nozzles being disposed except a swept range W of the walking-arm type revolving conveyance apparatus in a longitudinal direction of the steel pipe, the first spray nozzles including inclined spray nozzles that are disposed by being tilted toward the swept range W, and flat spray nozzles that are disposed adjacent to the inclined spray nozzles at equal intervals with a predetermined pitch D in the longitudinal direction of the steel pipe, the inclined spray nozzles being disposed by being offset by a distance S from the predetermined pitch D, and being tilted with an angle θ of 30° or less, where the angle θ is determined in terms of the relationship θ=arctan(S/H), where S is the distance from the predetermined pitch D of the flat spray nozzles and H is an injection height of the first spray nozzles.

[14] The method of manufacturing a steel pipe according to item [13], wherein the first spray nozzles disposed above the pipe are disposed opposite to each other across the longitudinal direction of the steel pipe lying in the middle.

[15] The method of manufacturing a steel pipe according to item [14], wherein the first spray nozzles disposed above the pipe are disposed opposite to each other with offset of a pitch of D/4 to 3D/4 along the longitudinal direction of the steel pipe.

[16] The method of manufacturing a steel pipe according to item [14] or [15], wherein the walking-arm type revolving conveyance apparatus includes a pipe hold-down member that holds down the steel pipe rotating on the rotatable supporting member.

[17] The method of manufacturing a steel pipe according to item [16], wherein the walking-arm type revolving conveyance apparatus includes second spray nozzles that rapidly cool a region where the first spray nozzles disposed above the pipe interfere with the pipe hold-down member.

[18] The method of manufacturing a steel pipe according to any one of items [13] to [17], wherein the rotatable supporting member, and/or the first spray nozzles disposed above the pipe are movable in a vertical direction according to an outer diameter of the steel pipe.

Aspects of the present invention have enabled rapid conveyance of a steel pipe, and the required period for rapid cooling process is short, improving the productivity of steel pipe production. Aspects of the present invention also have a manufacturing cost reducing effect because they do not involve conveyance troubles such as hitting damage and other troubles due to bending of a steel pipe during conveyance.

BRIEF DESCRIPTION OF THE DRAWINGS

FIG. 1 is a schematic view showing a configuration of equipment for quenching a steel pipe according to an embodiment of the present invention as viewed in an axial direction of a steel pipe.

FIG. 2 is a schematic view showing how first spray nozzles are disposed opposite to each other in a configuration of equipment for quenching a steel pipe according to an embodiment of the present invention as viewed in an axial direction of a steel pipe.

FIG. 3 is a schematic view showing how a first spray nozzle sprays cooling water at an end portion of a steel pipe.

FIG. 4 is a schematic view showing how the first spray nozzles are disposed (spray pattern) along a longitudinal direction of a steel pipe.

FIG. 5 is a schematic view of sprayed water from an inclined spray nozzle and a flat spray nozzle.

FIG. 6 (*a*) is a diagram representing how a cambered steel pipe and the first spray nozzles are disposed, and FIG. 6 (*b*) is a schematic view of the first spray nozzles disposed opposite to each other with an offset pitch.

FIG. 7 is a schematic view showing how a pipe hold-down member for holding down a steel pipe is disposed, in which (a) is a side view, and (b) is a view from the direction of arrow A in (a).

FIG. 8 is a schematic view showing how a steel pipe, first spray nozzles, pipe hold-down members, and second spray nozzles are disposed, in which (a) is a side view, and (b) is a view from the direction of arrow A in (a) of FIG. 8.

FIG. 9 is a schematic view showing a spray range (spread angle) of a spray nozzle.

FIG. 10 (*a*) and FIG. 10 (*b*) are schematic views showing how steel pipes and the first spray nozzles are disposed in rapidly cooling steel pipes of different outer diameters.

FIG. 11 is a diagram representing the spray pattern and the distribution of flow of cooling water measured in a longitudinal direction of a steel pipe in Examples of the present invention.

DETAILED DESCRIPTION OF EMBODIMENTS OF THE INVENTION

Embodiments of the present invention are described below with reference to the accompanying drawings. The present invention, however, is not limited to the following embodiments.

FIG. 1 is a schematic view showing a configuration of equipment for quenching a steel pipe according to aspects of the present invention as viewed in an axial direction of a steel pipe. The equipment for quenching a steel pipe according to aspects of the present invention includes a walking-arm type revolving conveyance apparatus (swing-arm type conveyance apparatus) 1 for conveying a steel pipe P, a rotatable supporting member 2 for rotating and supporting a steel pipe P conveyed by the walking-arm type revolving conveyance apparatus 1, and a spray nozzle 3 for rapidly cooling the steel pipe P from above as the steel pipe P rotates on the rotatable supporting member 2. The arrows in FIG. 1 represent the paths of the steel pipe P conveyed by the walking-arm type revolving conveyance apparatus 1.

The walking-arm type revolving conveyance apparatus 1 conveys a steel pipe P subjected to a heat treatment in the preceding step, or a hot-rolled high-temperature steel pipe P, onto the rotatable supporting member 2. The rotatable supporting member 2 rotates and supports the steel pipe P. After the walking-arm type revolving conveyance apparatus 1 has returned to its original position, the spray nozzle 3 provided above the steel pipe P rapidly cools steel pipe P with the sprayed cooling water as the steel pipe P rotates on the rotatable supporting member 2. After being cooled, the steel pipe P is conveyed to the next step by the walking-arm type revolving conveyance apparatus 1. The rotatable supporting member 2 may be any member, for example, such as steel rolls, provided that it rotates and supports the steel pipe.

In accordance with aspects of the present invention, the walking-arm type revolving conveyance apparatus 1 is used to convey a steel pipe. The walking-arm type revolving conveyance apparatus 1 has a faster conveyance speed than methods such as a method using a kicker, and enables rapid conveyance of a steel pipe. In addition, the walking-arm type revolving conveyance apparatus 1 does not involve conveyance troubles such as hitting damage and other troubles due to bending of a steel pipe during conveyance.

In accordance with aspects of the present invention, the steel pipe P is rapidly cooled while being rotated about the pipe axis at a predetermined position in a state where movements of steel pipe P in a direction parallel to and in a direction perpendicular to the pipe axis are stopped. In accordance with aspects of the present invention, "a state where movements of a steel pipe in a direction parallel to and in a direction perpendicular to the pipe axis of the steel pipe are stopped" means that the steel pipe is not positively moved in a pipe axis direction and in a direction perpendicular to the pipe axis direction when the steel pipe is rapidly cooled. Vibrations of the steel pipe generated due to the rotation of the steel pipe about the pipe axis, and unavoidable unintended movements of the steel pipe in a pipe axis direction and in a direction perpendicular to the pipe axis direction which may be generated due to such vibrations are included in the state where "movements of the steel pipe in a direction parallel to and in a direction perpendicular to the pipe axis of the steel pipe are stopped at a predetermined position".

In accordance with aspects of the present invention, a first spray nozzle 3 is disposed along the axial direction of the steel pipe P with an angle (angle $\alpha$ in FIG. 1) of 20 to 70° from the uppermost part of the pipe in the circumferential direction. When being conveyed by the walking-arm type revolving conveyance apparatus 1, the steel pipe P passes a line perpendicular to the central axis of the steel pipe P, above the uppermost part of the sitting pipe. When the angle $\alpha$ is less than 20°, the conveyance path of the steel pipe P becomes too close to the first spray nozzle 3, and the steel pipe P, when it has a camber, may contact the first spray nozzle 3 when being conveyed to the rotatable supporting member 2, with the result that the first spray nozzle 3 and the steel pipe P may be damaged. The possibility of damage increases when the first spray nozzles 3 are installed opposite to each other. For this reason, the angle $\alpha$ is 20° or more. When the angle $\alpha$ is larger than 70°, cooling water tends to splash around the quenching equipment, and the splashed water cools the preceding steel pipe and the succeeding steel pipe. In accordance with aspects of the present invention, the angle $\alpha$ is preferably 30° or more and less than 60°.

Preferably, more than one first spray nozzle 3 is disposed in a circumferential direction of the steel pipe. Providing more than one first spray nozzle 3 improves cooling performance and reduces cooling time, and productivity can improve. Preferably, the first spray nozzles 3 are disposed opposite to each other across the longitudinal direction of the steel pipe lying in the middle, as shown in FIG. 2. This is because the cooling water sprayed from the first spray nozzle 3 may otherwise partially splash, and misses the end portion of the steel pipe P (see FIG. 3). By disposing the first spray nozzles 3 opposite to each other, the sprays of cooling water collide and cancel out, preventing splashing of water.

FIG. 4 is a schematic view showing how the first spray nozzles 3 (31 and 32) are disposed (spray pattern) along a longitudinal direction of a steel pipe in accordance with aspects of the present invention. When the first spray nozzles 3 are disposed at equal intervals, the first spray nozzle (s) 3 disposed in a range W swept by the walking-arm type revolving conveyance apparatus 1 collides with the walking-arm type revolving conveyance apparatus 1.

That is, the walking-arm type revolving conveyance apparatus 1 does not allow the first spray nozzle 3 to be disposed in its swept range W.

In accordance with aspects of the present invention, as illustrated in FIG. 4, the first spray nozzles 3 are disposed except the swept range W of the walking-arm type revolving conveyance apparatus 1 in a longitudinal direction of a steel pipe. The first spray nozzles 3 can therefore avoid colliding with the walking-arm type revolving conveyance apparatus 1.

At the same time, rapid cooling of steel pipe P by cooling water is still necessary in the swept range W of the walking-arm type revolving conveyance apparatus 1. When a flat spray nozzle, which sprays the same amount of water in line symmetry with respect to the center axis of the nozzle, is tilted toward the swept range W, the spray distance will be different on the left and right of the center axis of the flat spray nozzle. This creates irregularities in the distribution of water flow in the longitudinal direction of a steel pipe when a flat spray nozzle 32 sprays cooling water from the tilted position. In this case, the steel pipe cannot have the desired properties (e.g., mechanical properties), and the yield becomes low.

The first spray nozzles 3 in the longitudinal direction of a steel pipe therefore include inclined spray nozzles 31 that are tilted toward the swept range W, and flat spray nozzles 32 that are disposed adjacent to the inclined spray nozzles 31 at equal intervals with a predetermined pitch D.

Rapid and uniform cooling of steel pipe P is possible when the flat spray nozzles 32 are disposed at equal intervals with a predetermined pitch, adjacent to the inclined spray nozzles 31. The flat spray nozzles 32 are disposed along the steel pipe P at equal intervals, including the end portions.

As illustrated in FIG. 4, the inclined spray nozzles 31 may be disposed in a pitch that is offset by a distance S from the predetermined pitch D of the flat spray nozzles 32, and are tilted with an angle θ of 30° or less, where θ is an angle determined in terms of the relationship $\theta=\arctan(S/H)$, where S is the distance from the predetermined pitch D of the flat spray nozzles and H is the injection height of the spray nozzle. When the angle θ ($\theta=\arctan(S/H)$) is larger than 30°, the impact force of cooling water becomes weak, and the cooling performance weakens. In FIG. 4, the angle θ is represented by $\theta_1$ and $\theta_2$. $\theta_1=\arctan(S_1/H_1)$, and $\theta_2=\arctan(S_2/H_2)$.

As illustrated in FIG. 5, unlike the flat spray nozzle 32 that sprays the same amount of water in line symmetry with respect to the center axis of the nozzle, the inclined spray nozzle 31 sprays different amounts of water in line asymmetry with respect to the center axis of the nozzle. That is, the cooling water sprayed from the inclined spray nozzle 31 at a predetermined angle θ and a predetermined injection height $H_1$ has the same spray range and the same distribution of water flow as the cooling water sprayed from the flat spray nozzle 32. This produces a uniform distribution of water flow in the longitudinal direction of a steel pipe in portions of steel pipe P hit by cooling water, and the steel pipe P can be evenly quenched, even though the inclined spray nozzle 31 spraying cooling water is tilted toward the swept range W. It should be noted here that the injection height H of the flat spray nozzle 32 is not necessarily required to be the same as the injection height $H_1$ of the inclined spray nozzle 31.

The number of inclined spray nozzles 31 is not particularly limited, and may be decided according to whether the inclined spray nozzle 31 interferes with the adjacent spray nozzle 3 (flat spray nozzle 32) with respect to position in longitudinal direction. For example, when the walking-arm type revolving conveyance apparatus 1 has a large swept range W and the inclined spray nozzle 31 interferes with the adjacent first spray nozzle 3 (flat spray nozzle 32), it is preferable that the adjacent first spray nozzle 3 be an inclined spray nozzle 31. For example, when the inclined spray nozzle 31 interferes with the adjacent first spray nozzle 3 in its position offset by $S_1$ in the longitudinal direction of the steel pipe from the pitch of the flat spray nozzles 32 disposed at equal intervals as shown in FIG. 4, the adjacent first spray nozzle 3 is selected to be an inclined spray nozzle 31 that is offset by $S_2$ in the longitudinal direction of the steel pipe.

The injection height H of the first spray nozzle 3 is not particularly limited, and may be decided according to the injection capability of the first spray nozzle 3.

In accordance with aspects of the present invention, the first spray nozzles disposed above the pipe are preferably disposed with offset of a pitch of D/4 to 3D/4 along the longitudinal direction of the steel pipe. FIG. 6 (*a*) is a diagram representing how the steel pipe P and the first spray nozzles 3 are disposed. For rapid cooling of a steel pipe P having a camber, the steel pipe P can be stably rotated using a pipe hold-down member 4 that holds down the steel pipe P, as mentioned above. However, as shown in FIG. 6 (*a*), the injection height H becomes different in circumferential direction and in longitudinal direction according to the amount of camber. Particularly, when the first spray nozzles 3 are disposed opposite to each other at the same positions along the longitudinal direction of a steel pipe, there will be portions of small water flow density between the first spray nozzles 3 in the longitudinal direction of the steel pipe, and a long cooling time will be required in order to provide the predetermined level of cooling at the portion where the water flow density decreases. This results in poor productivity. It is accordingly preferable in accordance with aspects of the present invention that the first spray nozzles disposed above the pipe be disposed opposite to each other with offset of a pitch of D/4 to 3D/4 along the longitudinal direction of the steel pipe, as shown in FIG. 6 (*b*). In this way, a uniform water flow density is created in the longitudinal direction of the steel pipe. The first spray nozzles in the example represented in FIG. 6 (*a*) and FIG. 6 (*b*) are flat spray nozzles. However, the first spray nozzles may be inclined spray nozzles, instead of flat spray nozzles.

Preferably, the pipe hold-down member 4 is used to hold down the upper portions of the steel pipe P rotating on the rotatable supporting member 2, as shown in FIG. 7. FIG. 7 is a schematic view showing how the pipe hold-down member for holding down a steel pipe is disposed, in which (a) is a side view, and (b) is a view from the direction of arrow A in (a). With the pipe hold-down member 4, the steel pipe P can stably rotate without jumping out on the rotatable supporting member 2, even when the steel pipe has a camber. The pipe hold-down member 4 may be any member, for example, such as steel rolls, provided that it can hold down the steel pipe P even when the steel pipe P is rotating.

When the pipe hold-down member 4 is used, the pipe hold-down member 4 interferes with the cooling water sprayed from the first spray nozzles 3, and there will be low flow-density portions in longitudinal direction, as shown in (a) of FIG. 7. Accordingly, a long cooling time will be required to provide the same predetermined level of cooling in these low water-flow-density portions. This results in poor productivity.

It is accordingly preferable to use a second spray nozzle 5 for rapid cooling of steel pipe P in regions of steel pipe P not sprayed with cooling water because of the interference of the first spray nozzles 3 and the pipe hold-down member 4. Preferably, the second spray nozzle 5 has the same water flow density as the first spray nozzle 3. The second spray nozzle 5 is adapted to cool regions where the first spray nozzles 3 and the pipe hold-down member 4 interfere with each other. Accordingly, the position of the second spray nozzle 5 is not particularly limited. It is, however, preferable to dispose the second spray nozzle 5 in positions that do not interfere with the first spray nozzles 3, in other words, in positions that do not interfere with the cooling of steel pipe P by the first spray nozzles 3. FIG. 8 (*a*) is a diagram showing the steel pipe P, the first spray nozzles 3, the pipe hold-down member 4, and the second spray nozzles 5 as viewed from the side, and FIG. 8 (*b*) is a view from the direction of arrow A in FIG. 8 (*a*) (i.e., a top view). For example, the second spray nozzle 5 may be disposed in regions opposite to the pipe hold-down member 4 across the steel pipe P, as in the second spray nozzles 5 indicated solely by solid lines in (a) of FIG. 8. The second spray nozzles 5 may be disposed in portions where the pipe hold-down member 4 is facing the steel pipe P, as in the second spray nozzles 5' indicated by solid lines and broken lines in (a) of FIG. 8, and by broken lines in (b) of FIG. 8. A plurality of second spray nozzles 5 and 5' may be disposed along the longitudinal direction of a steel pipe, as shown in (b) of FIG. 8.

The spray range of the spray nozzle 3 has a spread angle β of preferably 45° or less (FIG. 9). The cooling water sprayed with a spread angle β larger than 45° has essentially no contribution to the cooling performance, and only increases the construction and running costs.

In accordance with aspects of the present invention, it is preferable that the rotatable supporting member 2, and/or the first spray nozzle 3 disposed above the pipe be movable in vertical direction, according to the outer diameter of the steel pipe P. In quenching a steel pipe P' having a larger outer diameter than steel pipe P, the injection height H' for the steel pipe P' is shorter than the injection height H for steel pipe P, as shown in (a) of FIG. 10. In this case, the distribution of flow of cooling water may be disrupted in the longitudinal direction of the steel pipe, and the sprayed cooling water may miss portions of the steel pipe. It is accordingly preferable that the steel pipe P, and/or the first spray nozzle 3 be movable in vertical direction according to the outer diameter of steel pipe P so that the injection height H between the steel pipe P and the first spray nozzle 3 remains about the same, regardless of the outer diameter of the steel pipe P, as shown in (b) of FIG. 10. This creates a uniform distribution of flow along the longitudinal direction of the steel pipe, and the steel pipe P can be evenly cooled in quenching steel pipes P of different outer diameters. The quenched steel pipe can have the desired mechanical properties accordingly. The vertical movement of the rotatable supporting member 2 and the first spray nozzle 3 may be achieved using, for example, a lifting mechanism.

The steel pipe quenched by the quenching equipment according to aspects of the present invention may be tempered, as needed.

As described above, the quenching of a steel pipe with the quenching equipment according to aspects of the present invention enables rapid conveyance of the steel pipe, and improves the productivity of steel pipe production.

With regard to steel pipe manufacturing conditions, a steel pipe as raw material is rapidly cooled after heating (i.e., reheat quenching treatment), or a hot-rolled high-temperature steel pipe is directly subjected to rapid cooling (i.e., direct quenching treatment) using the method of rapid cooling (quenching equipment) according to aspects of the present invention described above. That is, manufacturing conditions other than quenching are not particularly limited, and may follow ordinary methods.

Example 1

The quenching equipment according to aspects of the present invention was used to investigate the irregularity in flow of cooling water in a longitudinal direction of a steel pipe. Specifically, the water flow density of cooling water was examined at different positions in a longitudinal direction of a steel pipe, and the irregularity in the flow (distribution of flow) of cooling water in a longitudinal direction of a steel pipe was investigated.

The water flow density was examined by calculating the water flow density of the cooling water sprayed from the spray nozzles in different areas divided in a 25-mm pitch in the spray range of spray nozzles along a longitudinal direction of a steel pipe. The irregularity in flow was measured as an index representing the difference between the maximum value and the minimum value of water flow density in each area.

The water flow density was determined as being acceptable when it was 1.5 $m^3/(m^2 \cdot min)$ or more (here, 1.5 $m^3/(m^2 \cdot min)$ or more is a target value for a steel pipe measuring 100 to 200 mm in outer diameter, and 3 to 20 mm in wall thickness). Temperature variation after cooling increases when the irregularity in flow in a longitudinal direction of a steel pipe is larger than 0.8 $m^3/(m^2 \cdot min)$. Because this leads to poor yield due to failure to provide the desired properties (e.g., mechanical properties) in a part of the steel pipe, the acceptable value of irregularity in flow was 0.8 $m^3/(m^2 \cdot min)$ or less.

The spray nozzle of the present example was positioned at an circumferential spray angle α of 45° from the uppermost part of the steel pipe (quenching equipment of FIG. 1). The flat spray nozzles were disposed at equal intervals (pitch D=300 mm) along the longitudinal direction of the steel pipe. The inclined spray nozzles were also disposed along the longitudinal direction of the steel pipe, except that the nozzles were tilted toward the swept range W, and were offset by distance $S_1$ (230 mm) and $S_2$ (96 mm) from the pitch D of the equal intervals in the longitudinal direction of the steel pipe. In Comparative Example, the inclined spray nozzles in the quenching equipment according to aspects of the present invention were replaced with flat spray nozzles. The inclined spray nozzles had an injection height $H_1$ of 429 mm, and $H_2$ of 406 mm, both in the present example and Comparative Example. The flat spray nozzles had an injection height H of 400 mm. The tilt angle toward the swept range W of the walking-arm type revolving conveyance apparatus was $\theta_1$=28°, and $\theta_2$=13°.

In Conventional Example, a steel pipe was conveyed by a method using a kicker in quenching equipment that had multiple flat spray nozzles, and a rotatable supporting member for rotating and supporting the steel pipe. The flat spray nozzles were disposed at equal intervals along the longitudinal direction of the pipe at 45°-angle positions from the uppermost part of the steel pipe.

The flat spray nozzles and the inclined spray nozzles sprayed cooling water at a rate of 50 L/min each.

The steel pipes used in the present example, Comparative Example, and Conventional Example all had an outer diameter of 172 mm, and a wall thickness of 10 mm.

The results are shown in FIG. 11. FIG. 11 is a diagram representing the spray pattern and the distribution of flow of cooling water (water flow densities at different positions) in the longitudinal direction of the steel pipe for the present example, Comparative Example, and Conventional Example.

As shown in FIG. 11, a water flow density of 1.5 $m^3/(m^2 \cdot min)$ or more was achieved in accordance with aspects of the present invention, even in the swept range of the walking-arm type revolving conveyance apparatus. The irregularity in flow in the longitudinal direction of the steel pipe was 0.8 $m^3/(m^2 \cdot min)$ or less. In Conventional Example, the water flow density was 1.5 $m^3/(m^2 \cdot min)$ or more, and the irregularity in flow in the longitudinal direction of the steel pipe was 0.8 $m^3/(m^2 \cdot min)$ or less.

In Comparative Example in which the flat spray nozzles were tilted, the steel pipe had regions with a water flow density of 1.5 $m^3/(m^2 \cdot min)$ or less as measured on the steel pipe surface in the swept range W of the walking-arm type revolving conveyance apparatus, and poor cooling performance due to film boiling was suspected. The irregularity in flow in the longitudinal direction of the steel pipe was 1.1 $m^3/(m^2 \cdot min)$, and was unacceptable.

In the quenching equipment according to aspects of the present invention, the required period for rapid cooling process was 6 seconds shorter than in Conventional Example, which represents a method using a kicker.

Example 2

A steel pipe was cooled with the first spray nozzles 3 disposed opposite to each other across the longitudinal direction of the steel pipe lying in the middle, as shown in FIG. 2. The quenching equipment conditions are the same as in the present example of Example 1, except that the quenching equipment of FIG. 2 was used. The steel pipe P had an outer diameter of 110 mm, and a wall thickness of 10 mm, and was cooled from 800° C. to 100° C. Because cooling water was sprayed from the opposing first spray nozzles 3, it was possible to reduce splashing of cooling water, and the required period for rapid cooling process was 16 seconds shorter than in Conventional Example, which represents a method using a kicker.

Example 3

A steel pipe P was cooled with the quenching equipment of Example 2. The first spray nozzles 3 disposed opposite to each other across the longitudinal direction of the steel pipe were offset with a nozzle pitch of D/2. The quenching equipment conditions are the same as in Example 2, except for the nozzle pitch of the first spray nozzles 3. The steel pipe P (outer diameter=110 mm, wall thickness=10 mm) had a camber that, by visual inspection, had a 20-mm difference between the central portion and end portions in the longitudinal direction of the steel pipe, and was cooled from 800° C. to 100° C. The steel pipe P was examined for uniformity of cooling (temperature distribution in longitudinal direction after cooling). Despite the camber, the steel pipe P had a uniform distribution of flow in longitudinal direction, and a small cooling irregularity of 20° C.

Example 4

A steel pipe P was cooled by using the quenching equipment of Example 3 installed with the pipe hold-down member 4. The quenching equipment conditions are the same as in Example 3, except for the pipe hold-down member 4. The steel pipe P (outer diameter=110 mm, wall thickness=10 mm) had a camber that, by visual inspection, had a 50-mm difference between the central portion and end portions in the longitudinal direction of the steel pipe, and was cooled from 800° C. to 100° C. Despite the large camber generated before the cooling of the pipe, the steel pipe P was able to stably rotate without jumping out, and quenching of the steel pipe P was possible. The steel pipe P was examined for uniformity of cooling (temperature distribution in longitudinal direction after cooling). Because the camber of the steel pipe P was reduced by the pipe hold-down member 4, the steel pipe P had a uniform distribution of flow in longitudinal direction, and a small cooling irregularity of 15° C.

Example 5

A steel pipe P was cooled with the quenching equipment of Example 4 after installing the second spray nozzles 5 (second spray nozzles 5 indicated solely by solid lines in (b) of FIG. 8) in regions opposite the pipe hold-down member 4 with the steel pipe P in between, as shown in (a) and (b) of FIG. 8. The conditions are the same as in Example 4, except for the second spray nozzles 5. As in Example 4, despite the camber generated before the cooling of the pipe, the steel pipe P was able to stably rotate without jumping out, and quenching of the steel pipe P was possible. The steel pipe P had no cooling irregularity in regions where the first spray nozzles 3 and the pipe hold-down member 4 interfered. The steel pipe P also had a small temperature distribution of 5° C. in longitudinal direction after cooling.

Example 6

The quenching equipment of Example 5 was used after installing a lifting mechanism for the rotatable supporting member 2. In order to quench a steel pipe P having an outer diameter of 192 mm, the rotatable supporting member 2 was moved down 90 mm in advance to provide an injection height H of 400 mm. The conditions are the same as in Example 5, except that the lifting mechanism was provided for the rotatable supporting member 2. Despite that the steel pipe had an outer diameter of 192 mm, the flow density in longitudinal direction was uniform, and there was no cooling irregularity. The steel pipe P also had a small temperature distribution of 7° C. in longitudinal direction after cooling.

REFERENCE SIGNS LIST

1 Walking-arm type revolving conveyance apparatus (swing-arm type conveyance apparatus)
2 Rotatable supporting member
3 First spray nozzle
31 Inclined spray nozzle
32 Flat spray nozzle
4 Pipe hold-down member
5 Second spray nozzle
5' Second spray nozzle
P Steel pipe
P' Steel pipe
W Swept range
D Pitch
S ($S_1$, $S_2$) Offset distance
H ($H_1$, $H_2$) Injection height
H' Injection height

The invention claimed is:

1. A method for quenching a steel pipe, the method comprising the steps of:

conveying a steel pipe onto a rotatable supporting member using a revolving conveyance apparatus; and cooling the steel pipe with first spray nozzles disposed above the pipe while the steel pipe is being rotated about a pipe axis of the steel pipe on the rotatable supporting member in a state where movements of the steel pipe in a direction parallel to and in a direction perpendicular to the pipe axis are stopped, the first spray nozzles being disposed along an axial direction of the steel pipe with an angle of 20 to 70° from the uppermost part of the pipe in a circumferential direction, the first spray nozzles being disposed except a swept range W of the revolving conveyance apparatus in a longitudinal direction of the steel pipe, the first spray nozzles including inclined spray nozzles that are disposed by being tilted toward the swept range W, and flat spray nozzles that are disposed adjacent to the inclined spray nozzles at equal intervals with a predetermined pitch D in the longitudinal direction of the steel pipe, the inclined spray nozzles being disposed by being offset by a distance S from the predetermined pitch D, and being tilted with an angle θ of 30° or less, where the angle θ is determined in terms of the relationship θ=arctan(S/H), where S is the distance from the predetermined pitch D of the flat spray nozzles and H is an injection height of the first spray nozzles, and the inclined spray nozzles spraying water asymmetrically with respect to a center axis of the inclined spray nozzles to produce a uniform distribution of water flow in the longitudinal direction of the steel pipe.

2. The method for quenching a steel pipe according to claim 1, wherein the first spray nozzles disposed above the pipe are disposed opposite to each other across the longitudinal direction of the steel pipe lying in the middle.

3. The method for quenching a steel pipe according to claim 2, wherein the first spray nozzles disposed above the pipe are disposed opposite to each other with offset of a pitch of D/4 to 3D/4 along the longitudinal direction of the steel pipe.

4. The method for quenching a steel pipe according to claim 2, wherein the revolving conveyance apparatus includes a pipe hold-down member that holds down the steel pipe rotating on the rotatable supporting member.

5. The method for quenching a steel pipe according to claim 4, wherein the revolving conveyance apparatus includes second spray nozzles that cool a region where the first spray nozzles disposed above the pipe interfere with the pipe hold-down member.

6. The method for quenching a steel pipe according to claim 1, further comprising moving the rotatable supporting member, and/or the first spray nozzles disposed above the pipe in a vertical direction based on an outer diameter of the steel pipe.

7. Equipment for quenching a steel pipe, the equipment comprising:

a revolving conveyance apparatus for conveying a steel pipe;

a rotatable supporting member that supports the steel pipe conveyed by the revolving conveyance apparatus, the rotatable supporting member supporting the steel pipe by rotating the steel pipe about a pipe axis of the steel pipe in a state where movements of the steel pipe in a direction parallel to and in a direction perpendicular to the pipe axis are stopped; and first spray nozzles that cool the steel pipe from above the steel pipe rotating on the rotatable supporting member, the first spray nozzles being disposed along an axial direction of the steel pipe with an angle of 20 to 70° from the uppermost part of the pipe in a circumferential direction, the first spray nozzles being disposed except a swept range W of the revolving conveyance apparatus in a longitudinal direction of the steel pipe, the first spray nozzles including inclined spray nozzles that are disposed by being tilted toward the swept range W, and flat spray nozzles that are disposed adjacent to the inclined spray nozzles at equal intervals with a predetermined pitch D in the longitudinal direction of the steel pipe, the inclined spray nozzles being disposed by being offset by a distance S from the predetermined pitch D, and being tilted with an angle θ of 30° or less, where the angle θ is determined in terms of the relationship θ=arctan(S/H), where S is the distance from the predetermined pitch D of the flat spray nozzles and H is an injection height of the first spray nozzles, and the inclined spray nozzles spraying water asymmetrically with respect to a center axis of the inclined spray nozzles to produce a uniform distribution of water flow in the longitudinal direction of the steel pipe.

8. The equipment for quenching a steel pipe according to claim 7, wherein the first spray nozzles disposed above the pipe are disposed opposite to each other across the longitudinal direction of the steel pipe lying in the middle.

9. The equipment for quenching a steel pipe according to claim 8, wherein the first spray nozzles disposed above the pipe are disposed opposite to each other with offset of a pitch of D/4 to 3D/4 along the longitudinal direction of the steel pipe.

10. The equipment for quenching a steel pipe according to claim 8, further comprising a pipe hold-down member that holds down the steel pipe rotating on the rotatable supporting member.

11. The equipment for quenching a steel pipe according to claim 10, further comprising second spray nozzles that cool a region where the first spray nozzles disposed above the pipe interfere with the pipe hold-down member.

12. The equipment for quenching a steel pipe according to claim 7, wherein the rotatable supporting member, and/or the first spray nozzles disposed above the pipe are movable in a vertical direction according to an outer diameter of the steel pipe.

13. A method of manufacturing a steel pipe by quenching whereby a steel pipe as raw material is cooled after heating, or a hot-rolled high-temperature steel pipe is directly subjected to cooling, the cooling in the quenching comprising the steps of:

conveying a steel pipe onto a rotatable supporting member using a revolving conveyance apparatus; and cooling the steel pipe with first spray nozzles disposed above the pipe while the steel pipe is being rotated about a pipe axis of the steel pipe on the rotatable supporting member in a state where movements of the steel pipe in a direction parallel to and in a direction perpendicular to the pipe axis are stopped, the first spray nozzles being disposed along an axial direction of the steel pipe with an angle of 20 to 70° from the uppermost part of the pipe in a circumferential direction, the first spray nozzles being disposed except a swept range W of the revolving conveyance apparatus in a longitudinal direction of the steel pipe, the first spray nozzles including inclined spray nozzles that are disposed by being tilted toward the swept range W, and flat spray nozzles that are disposed adjacent to the inclined spray nozzles at equal intervals with a predetermined pitch D in the longitudinal direction of the steel pipe, the inclined spray nozzles being disposed by being offset by a distance S from the predetermined pitch D, and being tilted with an angle θ of 30° or less, where the angle θ is determined in terms of the relationship $\theta=\arctan(S/H)$, where S is the distance from the predetermined pitch D of the flat spray nozzles and H is an injection height of the first spray nozzles, and the inclined spray nozzles spraying water asymmetrically with respect to a center axis of the inclined spray nozzles to produce a uniform distribution of water flow in the longitudinal direction of the steel pipe.

14. The method of manufacturing a steel pipe according to claim 13, wherein the first spray nozzles disposed above the pipe are disposed opposite to each other across the longitudinal direction of the steel pipe lying in the middle.

15. The method of manufacturing a steel pipe according to claim 14, wherein the first spray nozzles disposed above the pipe are disposed opposite to each other with offset of a pitch of D/4 to 3D/4 along the longitudinal direction of the steel pipe.

16. The method of manufacturing a steel pipe according to claim 14, wherein the revolving conveyance apparatus includes a pipe hold-down member that holds down the steel pipe rotating on the rotatable supporting member.

17. The method of manufacturing a steel pipe according to claim 16, wherein the revolving conveyance apparatus includes second spray nozzles that rapidly cool a region where the first spray nozzles disposed above the pipe interfere with the pipe hold-down member.

18. The method of manufacturing a steel pipe according to claim 13, further comprising moving the rotatable supporting member, and/or the first spray nozzles disposed above the pipe in a vertical direction based on an outer diameter of the steel pipe.

* * * * *